US005259285A

United States Patent [19]

Uchida

[11] Patent Number: 5,259,285

[45] Date of Patent: Nov. 9, 1993

[54] THREE SIDE TRIMMER

[75] Inventor: Hitoshi Uchida, Kyoto, Japan

[73] Assignee: Horizon International Inc., Shinasahimachi

[21] Appl. No.: 976,141

[22] Filed: Nov. 10, 1992

[30] Foreign Application Priority Data

Nov. 12, 1991 [JP] Japan ..... 3-110300[U]

[51] Int. Cl.[5] ..... B26D 1/09

[52] U.S. Cl. ..... 83/620; 83/934

[58] Field of Search ..... 83/560, 620, 640, 641, 83/934

[56] References Cited

U.S. PATENT DOCUMENTS

| | | | |
|---|---|---|---|
| 2,482,685 | 9/1949 | Moyer | 83/934 X |
| 3,198,051 | 8/1965 | Ablon | 83/620 X |
| 3,811,350 | 5/1974 | Marciniak | 83/620 X |
| 4,922,773 | 5/1990 | Ito | 83/934 X |

FOREIGN PATENT DOCUMENTS

| | | | |
|---|---|---|---|
| 659390 | 4/1938 | Fed. Rep. of Germany . | |
| 3300999 | 9/1983 | Fed. Rep. of Germany . | |
| 8805587 | 4/1988 | Fed. Rep. of Germany . | |
| 9116181 | 10/1991 | World Int. Prop. O. | 83/934 |

OTHER PUBLICATIONS

Abstract of Japanese Utility-Model Publication No. 26960 of 1985 plus English-language translation.

Abstract of Japanese Laid-Open Patent Publication No. 109693 of 1986 plus English-language translation.

*Primary Examiner*—Eugenia Jones

*Attorney, Agent, or Firm*—Morgan & Finnegan

[57] ABSTRACT

A three side trimmer is provided with a trimming table having a base, a first cutting stick fixed on the base opposed to a front edge trimming cutter in order to receive the knife edge of the front edge trimming cutter and, a table structure including a pair of elemental plates movable on the base along a direction parallel to the length of the first cutting stick. The first elemental plate of the table structure is provided with a second cutting stick arranged perpendicular to the first cutting stick in order to receive the knife edge of a top edge trimming cutter. The second elemental plate of the table structure is provided with a third cutting stick arranged perpendicular to the first cutting stick in order to receive the knife edge of a foot edge trimming cutter. The three side trimmer makes it possible to trim the three sides of the binding objects of different sizes without exchanging the trimming tables.

1 Claim, 3 Drawing Sheets

THREE SIDE TRIMMER

BACKGROUND OF THE INVENTION

This invention relates to a three side trimmer.

The three side trimmer is employed to trim three sides of a binding object. In some of the three side trimmers, the trimming operation is performed by clamping the binding object, and cutting the top and foot edges of the binding object at the same time, and cutting the front edge of the binding object at some other appropriate time. Such type of three side trimmer includes, mainly, an opposed top edge trimming cutter and a foot edge trimming cutter, a front edge trimming cutter, and a trimming table for supporting the binding object thereon.

FIGS. 4 and 5 illustrate the above-mentioned three side trimmer. In FIGS. 4 and 5, the numerals (11), (12) and (13) designate a top edge trimming cutter, a foot edge trimming cutter and a front edge trimming cutter, respectively. The top edge trimming cutter (11) and the foot edge trimming cutter (12) are spaced in parallel with each other for the same vertical movement in order to simultaneously cut the top and foot edges of the binding object. The front edge trimming cutter (13) is arranged perpendicular to the cutters (11) and (12) for vertical movement in order to cut the front edge of the binding object prior to or after the cutting operation of the cutters (11), (12). Furthermore, the top edge trimming cutter (11) and the foot edge trimming cutter (12) are arranged for relative movement therebetween along the direction parallel to the length of the front edge trimming cutter (13) according to the size of the binding object.

The numeral (14) designates a trimming table disposed beneath the cutters (11), (12) and (13) for supporting the binding object thereon. The trimming table (14) comprises a table plate (15), and cutting sticks of, for example hard rubber (16A)–(16C) arranged on the sides of the table plate (15) for receiving the knife edges of the cutters. The binding object is fed onto the trimming table (14) and the top, foot and front edges of the binding object are cut by the cutters (11), (12), (13).

The numeral (17) designates a securing press for fixing the binding object on the trimming table (14). The securing press (17) is detachably attached to a jig (18) supported on a device such as an elevator for vertical movement.

In general, such type of three side trimmer is intended to trim three sides of binding objects of various sizes. In this case, it is necessary that the size of the trimming table (14) should be almost the same as that of the binding object in order to prevent scraps of binding sheets being left on the trimming table (14). As a result, it is required to provide a number of trimming tables with different sizes according to a variety of the binding object sizes. Thus, in the case of trimming three sides of binding objects of different sizes, the trimming tables should be exchanged. In this case, it is considerably dangerous to exchange the trimming tables because the trimming table is disposed beneath the respective cutters. In addition, the trimming table is designed in such a manner to provide sufficient mechanical strength for use, so that close attention should be paid to the trimming table exchange operation.

SUMMARY OF THE INVENTION

It is the object of the present invention to make it possible to trim the three sides of binding objects of different sizes without exchanging the trimming tables.

According to the present invention there is provided a three side trimmer which is provided with a top edge trimming cutter and a foot edge trimming cutter spaced in parallel with each other. A front edge trimming cutter is arranged perpendicular to the top edge trimming cutter and said foot edge trimming cutter, with a trimming table arranged beneath the trimming cutters for supporting a binding object thereon. The top edge trimming cutter and the foot edge trimming cutter are arranged for relative movement therebetween along a direction parallel to the length of the front edge trimming cutter according to the size of the binding object, characterized in that the trimming table includes: a base; a first cutting stick fixed on the base, the first cutting stick being arranged opposed to the front edge trimming cutter in order to receive the knife edge of the front edge trimming cutter; and a table structure which is adapted to place the binding object thereon. The table structure includes a pair of elemental plates movable on the base along a direction parallel to the length of the first cutting stick, with the first elemental plate of the table structure being provided with a second cutting stick, the second cutting stick being arranged perpendicular to the first cutting stick in order to receive the knife edge of the top edge trimming cutter, and the second elemental plate of the table structure being provided with a third cutting stick, the third cutting stick being arranged perpendicular to the first cutting stick in order to receive the knife edge of said foot edge trimming cutter. Means are also provided for moving the pair of elemental plates of the table structure.

In accordance with a preferred embodiment, the base is provided with slide guide means extending along a direction parallel to the length of the first cutting stick for guiding the pair of elemental plates for relative movement therebetween.

In accordance with another preferred embodiment, the relative movement between the pair of elemental plates is affected by movement of the pair of elemental plates in the opposed directions to one another.

In accordance with another preferred embodiment, the means for moving the pair of elemental plates of the table structure includes: a shaft supported on the base for rotation about its axis, the shaft extending perpendicular to the direction of movement of the pair of elemental plates, the shaft being provided with a handle at its one end and a spiral gear at its other end; a crown gear engaged with the spiral gear of the shaft; first and second threaded rods extending from the crown gear in opposite directions to each other along the direction of movement of the pair of elemental plates, the first threaded rod being screwed through the first elemental plate, the second threaded rod being screwed through the second elemental plate, the tip portion of the first threaded rod being supported on a bearing fixed to the base, the first and second threaded rods being threaded in opposite hands to one another.

When the top edge trimming cutter and the foot edge trimming cutter are moved with respect to each other according to the sizes of the binding objects, the first and second elemental plates are also moved with respect to each other so that the second and third cutting sticks are positioned beneath the top edge trimming cutter and the foot edge trimming cutter, respectively. At the same time, a binding object is set in position on the trimming table so as to position its front edge on the first cutting stick.

Accordingly, the present invention is advantageous in that it makes possible to trim three sides of various binding objects of different sizes without exchanging the trimming tables.

BRIEF DESCRIPTION OF DRAWINGS

The other objects and features of this invention will become understood from the following description with reference to the accompanying drawings in which.

DETAILED DESCRIPTION OF THE PREFERRED EMBODIMENTS

Figure 1:
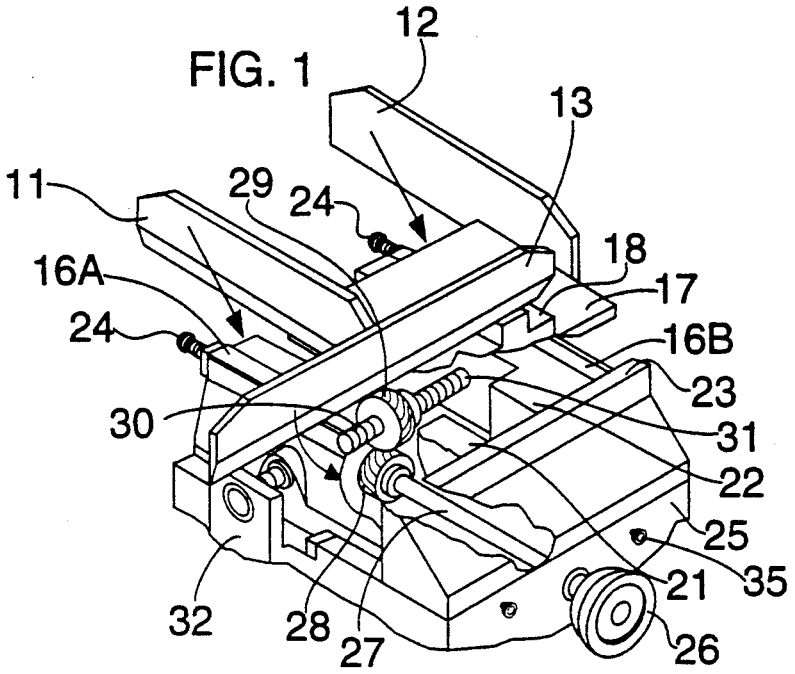
FIG. 1 is a perspective view showing an embodiment of a three side trimmer according to the present invention.
Figure 3:
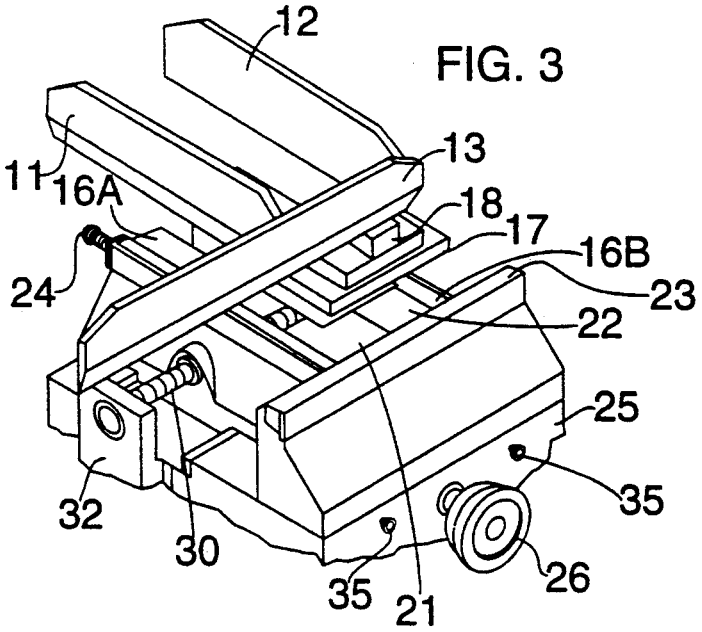
FIG. 3 is a perspective view of a trimming table of the three side trimmer of FIG. 1 for trimming three sides of a relatively small size binding object.
Figure 2:
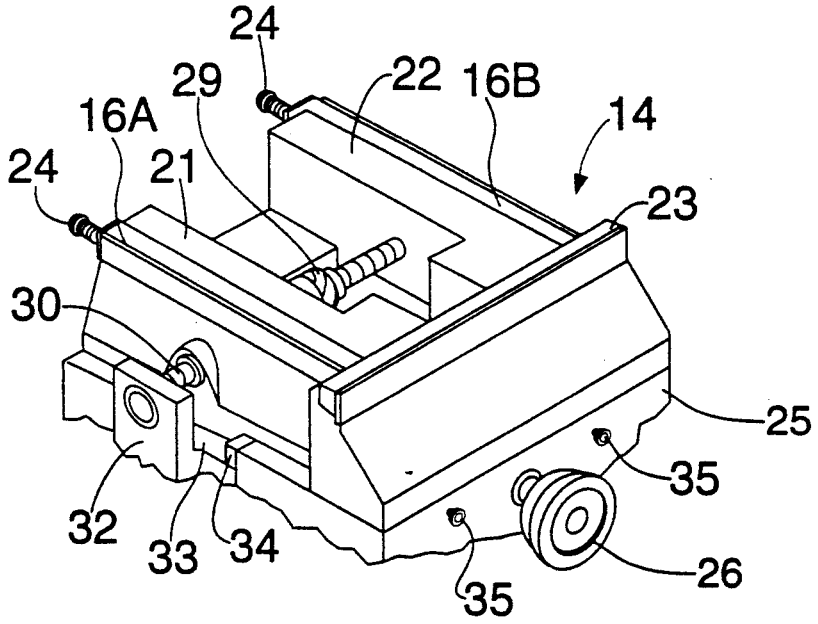
FIG. 2 is a perspective view showing the trimming table of the three side trimmer shown in FIG. 1.

Referring to FIGS. 1-3, an embodiment of a three side trimmer according to the present invention will be described in detail. In FIGS. 1-3, the same number as that of FIG. 4 is assigned to an element identical with that of FIG. 4 or corresponding to that of FIG. 4.

As shown in FIG. 1, a top edge trimming cutter (11) and a foot edge trimming cutter (12) are spaced in parallel with each other for the same vertical movement in order to simultaneously cut the top and foot edges of a binding object. A front edge trimming cutter (13) is arranged perpendicular to the top edge trimming cutter (11) and the foot edge trimming cutter (12) for vertical movement in order to cut the front edge of the binding object. The top edge trimming cutter (11) and the foot edge trimming cutter (12) are arranged for relative movement therebetween along a direction parallel to the length of the front edge trimming cutter (11) according to the size of the binding object.

A trimming table (14) is arranged beneath the three cutters (11), (12) and (13) for supporting the binding object thereon. The trimming table (14) includes a base (25), a first cutting stick (23) fixed on the base (25), a table structure consisting of a pair of elemental plates (21), (22) movable on the base (25) along a direction parallel to the length of the first cutting stick (23).

Figure 4:
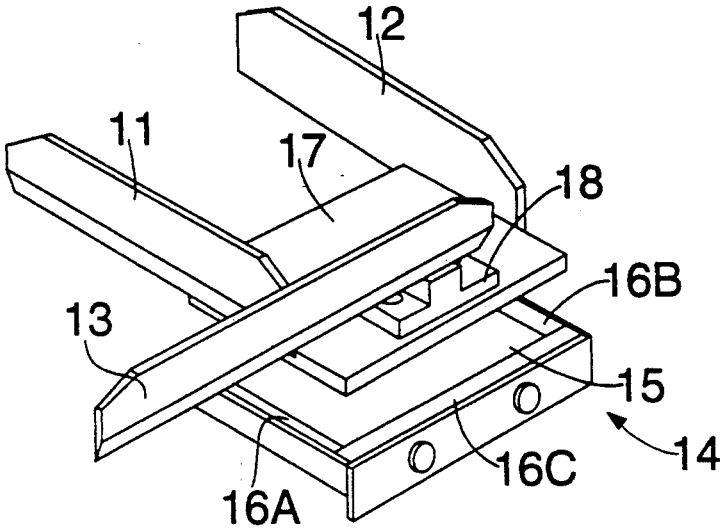
FIG. 4 is a perspective view of a prior three side trimmer.
Figure 5:
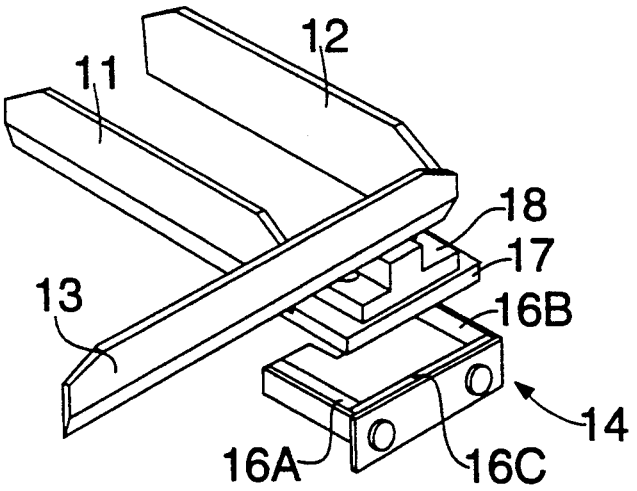
FIG. 5 is a perspective view of the three side trimmer of FIG. 4 for trimming three sides of a relatively small size binding object.

The first cutting stick (23), which corresponds to the cutting stick (16C) of FIG. 4, is opposedly arranged to the front edge trimming cutter (13) in order to receive the knife edge of the front edge trimming cutter (13). The pair of elemental plates (21), (22), which are of symmetric shapes with respect to each other, for example, L-shaped, are arranged opposite to each other. The first elemental plate (21) of the table structure is provided with a second cutting stick (16A) which is arranged perpendicular to the first cutting stick (23) in order to receive the knife edge of the top edge trimming cutter (11). The second elemental plate (22) of the table structure is provided with a third cutting stick (16B) which is arranged perpendicular to the first cutting stick (23) in order to receive the knife edge of the foot edge trimming cutter (12). The second and third cutting sticks (16A) and (16B) are detachably attached to their respective associated elemental plates by screw threads (24).

The base (25) is provided with a dovetail groove (33) thereon. The dovetail groove (33) extends in a direction parallel to the length of the first cutting stick (23). The foot portions of the first and second elemental plates (21), (22) are fitted in the dovetail groove (33) so that the first and second elemental plates (21), (22) are guided for sliding movement along the dovetail groove (33).

A shaft (27) is supported on the base (25) for rotation about its axis. The shaft (27) extends perpendicular to the direction of the movement of the pair of elemental plates (21), (22). The shaft (27) is provided with a handle (26) at its one end and a spiral gear (28) at its other end.

A crown gear (29) is engaged with the spiral gear (28) of the shaft (27). First and second threaded rods (30) and (31) extend from the crown gear (29) in the opposite directions to each other along the direction of movement of the pair of elemental plates (21), (22), respectively. Furthermore, the first threaded rod (30) is screwed through the first elemental plate (21) and the tip portion of the first threaded rod (30) is supported on a bearing (32) fixed to the base (25). The second threaded rod (31) is screwed through the second elemental plate (22). The first and second threaded rods (30) and (31) are threaded in opposed hands to one another.

The first and second threaded rods (30) and (31) are rotated about their axes by the rotation of the handle (26) so that the first elemental plate (21) and the second elemental plate (22) are moved by equal distances in opposite directions to each other so that the second and third cutting sticks (16A), (16B) are positioned beneath the top edge trimming cutter (11) and the foot edge trimming cutter (12), respectively. The first elemental plate (21) and the second elemental plate (22) can be fixed at an appropriate position by driving the screw threads (35) to push stoppers (34) of the dovetail groove toward and into engagement with the first and second elemental plates (21), (22), respectively.

The binding object is set in position on the trimming table (14) in such a manner that its spine is disposed opposite to the first cutting stick (23). At the same time, the front edge of the binding object is adjusted by a stopper (not shown) so as to position the front edge on the first cutting stick (23). The positions of the cutters (11)-(13) are adjusted to the size of the binding object.

Then the positions of the first and second elemental plates (21), (22) are adjusted by turning the handle (26) in such a manner that the second and third cutting sticks (16A) and (16B) are positioned beneath the top edge trimming cutter (11) and the foot edge trimming cutter (12), respectively. Thereafter the top edge trimming cutter (11) and the foot edge trimming cutter (12) are simultaneously lowered in the direction shown by the arrows on FIG. 1 to together trim the top and foot edges of the binding object. The front edge trimming cutter (13) is also lowered in the direction shown by its associated arrow on FIG. 1 to trim the front edge of the binding object. In this case, it is also possible to trim the front edge of the binding object prior to the top and foot edge trimming operation.

FIG. 3 illustrates a trimming table of the three side trimmer of FIG. 1 for trimming three sides of a relatively small size binding object. In FIG. 3, the first and second elemental plates (21), (22) are close to each other. The securing press (17) can be appropriately exchanged for a smaller one in trimming sides of a smaller size binding object.

In this specification, the terms "top" and "foot" only define the relative positions. Therefore these terms can be interchanged with each other in the specification.

Furthermore, the shapes of the first and second elemental plates are not limited to those of this embodiment as long as they are symmetric with respect to each other. However, if the first and second elemental plates (21), (22) are L-shaped, there is provided a space between them. Such space can be employed for installing a conveyor for taking out the binding object after the trimming operation. The conveyer also serves as additional support for the binding object.

It is necessary that the second and third cutting sticks (16A), (16B) should be positioned beneath the associated cutters. Therefore in the prior three side trimmer, the cutting sticks always receive the knife edges of the associated cutters at the same positions because the cutting sticks are arranged in fixed positions. On the other hand, in this embodiment, the first and second elemental plates (21), (22) can be varied so that the second and third cutting sticks (16A) and (16B) can receive the knife edges of the associated cutters at slightly varied positions during each trimming operation. Consequently, this makes it possible for the cutting sticks to have a longer life.

According to the present invention, even though it is necessary to trim sides of binding objects of different sizes, there is no need to exchange the trimming tables in order to adapt the trimming table to the size of the binding object. As a result, there is no need of providing a number of trimming tables of different sizes. In addition, the dangerous work in the trimming table exchange operation is not required.

I claim:

1. A three side trimmer having: a plurality of trimming cutters including a top edge trimming cutter and a foot edge trimming cutter having a length spaced in parallel to said top edge trimming cutter, and a front edge trimming cutter arranged perpendicular to said top edge trimming cutter and said foot edge trimming cutter; a trimming table arranged beneath said plurality of trimming cutters for supporting a binding object thereon, said top edge trimming cutter and said foot edge trimming cutter being arranged for relative movement therebetween along a direction parallel to the length of said front edge trimming cutter according to the size of the binding object, characterized in that said trimming table comprises:

a base;

a first cutting stick fixed on said base, said first cutting stick having a length and being arranged opposite said front edge trimming cutter in order to receive a knife edge of said front edge trimming cutter;

a table structure which is adapted to place the binding object thereon, said table structure comprising a pair of elemental plates movable on said base along a direction parallel to the length of said first cutting stick, the first elemental plate of said table structure being provided with a second cutting stick, said second cutting stick being arranged perpendicular to said first cutting stick in order to receive a knife edge of said top edge trimming cutter, the second elemental plate of said table structure being provided with a third cutting stick, said third cutting stick being arranged perpendicular to said first cutting stick in order to receive a knife edge of said foot edge trimming cutter;

slide guide means arranged on said base and extending along a direction parallel to the length of said first cutting stick for guiding said pair of elemental plates for relative movement therebetween;

means for moving said pair of elemental plates of said table structure in opposite directions, said moving means comprising a rotatable shaft supported on said base for rotation about an axis of said shaft, said shaft extending perpendicular to the direction of movement of said pair of elemental plates, said shaft being provided with a handle at one end and a spiral gear at an opposed end; a crown gear engaged with said spiral gear of said shaft; first and second threaded rods extending from said crown gear in opposite directions from one another along the direction of movement of said pair of elemental plates, said first threaded rod being screwed through said first elemental plate, said second threaded rod being screwed through said second elemental plate, a tip portion of said first threaded rod being supported on a bearing fixed to said base, said first and second threaded rods being reversibly threaded with respect to one another.

* * * * *